US010692679B2

(12) United States Patent
Henricks et al.

(10) Patent No.: US 10,692,679 B2
(45) Date of Patent: Jun. 23, 2020

(54) MODULAR FUSE REMOVAL TOOL ACCESSORY, KIT, AND SYSTEMS FOR FUSIBLE DISCONNECT DEVICE

(75) Inventors: Michael C. Henricks, Ballwin, MO (US); Haimin Li, Xi'an (CN); Jessica A. Dunker, Edwardsville, IL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 1399 days.

(21) Appl. No.: 13/449,867

(22) Filed: Apr. 18, 2012

(65) Prior Publication Data

US 2013/0278375 A1 Oct. 24, 2013

(51) Int. Cl.

| | |
|---|---|
| ***H01H 85/041*** | (2006.01) |
| ***H01H 85/02*** | (2006.01) |
| ***H01H 9/10*** | (2006.01) |
| ***H01H 21/16*** | (2006.01) |

(52) U.S. Cl.

CPC ..... *H01H 85/041* (2013.01); *H01H 9/104* (2013.01); *H01H 85/0208* (2013.01); *H01H 21/16* (2013.01)

(58) Field of Classification Search

CPC .. H01H 85/0208; H01H 85/041; H01H 9/104; B25B 9/02; B25B 9/00

USPC ..... 81/3.8

See application file for complete search history.

(56) References Cited

U.S. PATENT DOCUMENTS 1,741,222 A * 12/1929 Brown ..... 81/3.8
2,454,878 A * 11/1948 Marler ..... 81/3.8
4,094,212 A * 6/1978 Hyams et al. ..... 81/3.8
4,475,283 A * 10/1984 Olson et al. ..... 29/720
5,044,058 A * 9/1991 Voss ..... 29/278
5,488,345 A * 1/1996 Seki et al. ..... 337/186
5,666,865 A * 9/1997 Ito ..... H01H 85/0208 29/278
5,751,208 A * 5/1998 Martinez ..... 337/198
5,841,337 A 11/1998 Douglass
5,973,418 A 10/1999 Ciesielka et al.
6,157,287 A 12/2000 Douglass et al.
6,696,969 B2 2/2004 Torrez et al.
6,784,783 B2 8/2004 Scoggin et al.
6,853,289 B2 2/2005 Scoggin
6,871,567 B2 * 3/2005 Pinana Lopez .... H01H 85/0208 29/278
7,049,973 B2 5/2006 Torrez et al.
(Continued)

FOREIGN PATENT DOCUMENTS

GB 163562 A * 5/1921 ..... H04H 85/30

OTHER PUBLICATIONS

Bimmerfest, "Removing Fuse Behind Glove Box", 2009, Mar. 8, Post #2.*

*Primary Examiner* — David B Thomas
(74) *Attorney, Agent, or Firm* — Armstrong Teasdale LLP

(57) ABSTRACT

A removal tool accessory for replacing rectangular fuse modules of a fusible switching disconnect device. The removal tool accessory is a single piece part configured to snap-fit with the rectangular fuse module via opposing lateral sides thereof. The accessory includes an opening dimensioned to receive a person's index finger, middle finger, ring finger, and baby finger. A handlebar is provided for optimal mechanical leverage to pull the rectangular fuse module from the fusible switching disconnect device even when access to the rectangular fuse module is restricted.

21 Claims, 6 Drawing Sheets

(56) References Cited

U.S. PATENT DOCUMENTS

| | | | | |
|---|---|---|---|---|
| 7,384,086 | B2 * | 6/2008 | Lukaszynski | H01H 85/0208 29/278 |
| 7,385,518 | B2 | 6/2008 | Torrez et al. | |
| 7,474,194 | B2 | 1/2009 | Darr et al. | |
| 7,495,540 | B2 | 2/2009 | Darr et al. | |
| 7,561,017 | B2 | 7/2009 | Darr et al. | |
| 7,576,630 | B2 | 8/2009 | Darr | |
| 7,721,626 | B2 * | 5/2010 | Obama et al. | 81/3.8 |
| 7,825,766 | B2 | 11/2010 | Darr et al. | |
| 7,855,630 | B2 | 12/2010 | Darr | |
| 7,855,873 | B2 | 12/2010 | Darr et al. | |
| 7,924,136 | B2 | 4/2011 | Darr et al. | |
| 8,089,335 | B2 | 1/2012 | Darr et al. | |
| 8,134,828 | B2 | 3/2012 | Creighton et al. | |
| 8,414,334 | B2 * | 4/2013 | Nakayama et al. | 439/620.01 |
| 8,507,809 | B2 * | 8/2013 | Nakayama et al. | 174/541 |
| 2011/0163836 | A1 | 7/2011 | Darr et al. | |
| 2011/0163837 | A1 | 7/2011 | Darr et al. | |
| 2011/0169599 | A1 | 7/2011 | Darr et al. | |
| 2011/0193675 | A1 | 8/2011 | Darr et al. | |

* cited by examiner

MODULAR FUSE REMOVAL TOOL ACCESSORY, KIT, AND SYSTEMS FOR FUSIBLE DISCONNECT DEVICE

BACKGROUND OF THE INVENTION

The field of the invention relates generally to fusible disconnect devices, and more specifically to fused disconnect devices including accessories facilitating removal of the fuses from disconnect switches.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuits through the fuse to prevent electrical component damage.

A variety of fusible disconnect devices are known in the art wherein fused output power may be selectively switched from a power supply. Existing fusible disconnect switch devices, however, have not completely met the needs of those in the art.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
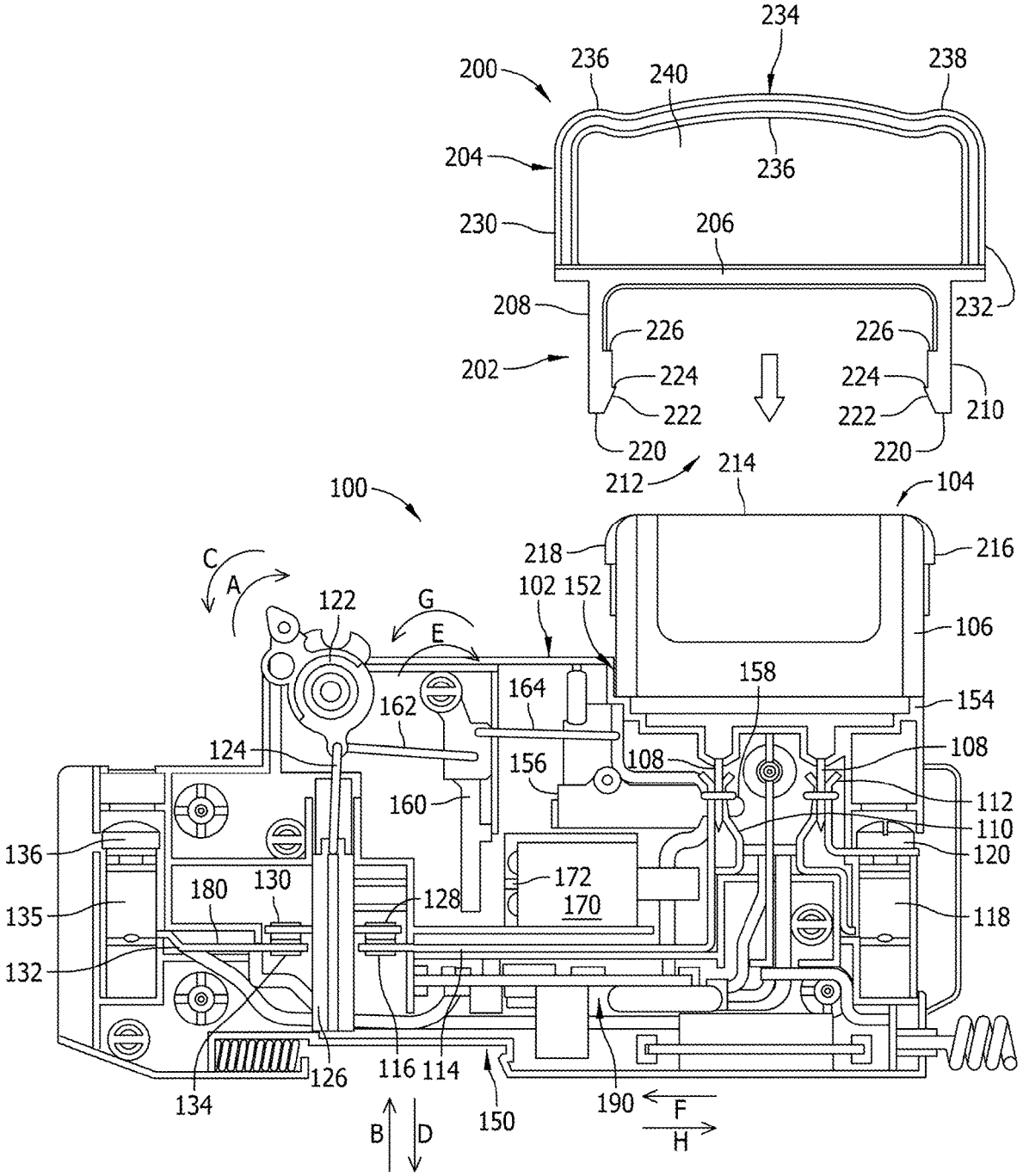
FIG. 1 is a side elevational view of a portion of an exemplary embodiment of a fusible switching disconnect device and an exemplary accessory for removing the fuse.

FIG. 1 is a side elevational view of a portion of an exemplary embodiment of a fusible switching disconnect device 100 and a removal tool accessory 200 therefor. The disconnect device 100 generally includes a disconnect housing 102 and a finger-safe rectangular fuse module 104 having terminal blades received in pass through openings in the top of the disconnect device 100 such that the fuse module 104 can be plugged-in to the disconnect housing 102 or removed from the disconnect housing 102 by hand by grasping the exposed housing of the rectangular fuse module and either pushing it toward the disconnect housing 102 to engage the terminal blades or pulling it away from the disconnect housing 102 to disengage the terminal blades from connecting terminals in the disconnect housing 102. Such an arrangement has been well received and one of its benefits is that it does not require conventional tools to engage or disengage conventional fasteners to remove or install the fuse module 104. On occasion, however, the fuse modules 104 can be difficult to remove from the disconnect device 100 by hand, especially when a number of disconnect devices 100 are arranged side-by-side such that physical access to grasp the fuse module 104 with ones fingers is limited. On other occasions, the force required to pull the fuse module 104 from the disconnect housing 102 is sufficiently great that certain persons may have difficulty removing the fuse module 104. Of course, the most problematic situations involve both restricted access and relatively high removal forces for any given fuse module 104.

The removal tool accessory 200, as explained below, facilitates a more convenient removal of a fuse from the device 100 when desired. The removal tool accessory 200 requires minimal physical access proximate the exterior of the fuse module 104, while providing increased mechanical leverage to pull the fuse module 104 from the disconnect housing 102 when necessary. The removal tool accessory 200 may be snap-fit to the fuse module 104 and easily removed therefrom without requiring fastener tools (e.g., screwdrivers, wrenches and the like) and conventional fasteners (e.g., screws, bolts and nuts). By avoiding external fasteners such as screws, bolts and nuts, the tool accessory 104 allows fuse replacement more quickly than conventional fusible disconnect devices utilizing such fasteners to secure a fuse therein. Also, the tool accessory 104 is fabricated in an integral or single piece construction without moving parts and is therefore economical to manufacture and avoids reliability issues of conventional fuse puller devices having multi-piece constructions that pivot or rotate relative to one another to grip external surfaces of a fuse. Method aspects implementing advantageous features will be in part apparent and in part explicitly discussed in the description below.

The device 100 includes a disconnect housing 102 fabricated from an electrically nonconductive or insulative material such as plastic, and the disconnect housing 102 is configured or adapted to receive a retractable rectangular fuse module 104. The disconnect housing 102 and its internal components described below, are sometimes referred to as a base assembly that receives the retractable fuse module 104. The internal components of the disconnect housing 102 include switching elements and actuator components described further below, although it should be understood that the disconnect housing 102 and its internal components represent only on example of possible disconnect devices adapted for use with the rectangular fuse module 104 and the removal tool accessory 200.

The fuse module 104 in the exemplary embodiment shown includes a rectangular housing 106 fabricated from an electrically nonconductive or insulative material such as plastic, and conductive terminal elements in the form or terminal blades 108 extending from the housing 106. In the example shown, the terminal blades 108 extend in spaced apart but generally parallel planes extending perpendicular to the plane of the page of FIG. 1. A primary fuse element or fuse assembly is located within the housing 106 and is electrically connected between the terminal blades 108 to provide a current path therebetween. Such fuse modules 104 are known and in one embodiment the rectangular fuse module 104 is a CUBEFuse™ power fuse module commercially available from Cooper Bussmann of St. Louis, Mo. The fuse module 104 provides overcurrent protection via the primary fuse element therein that is configured to melt, disintegrate or otherwise fail and permanently open the current path through the fuse element between the terminal blades 108 in response to predetermined current conditions flowing through the fuse element in use. When the fuse element opens in such a manner, the fuse module 104 must be removed and replaced to restore affected circuitry.

A variety of different types of fuse elements, or fuse element assemblies, are known and may be utilized in the fuse module 104 with considerable performance variations in use. Also, the fuse module 104 may include fuse state indication features, a variety of which are known in the art, to identify the permanent opening of the primary fuse element such that the fuse module 104 can be quickly identified for replacement via a visual change in appearance when viewed from the exterior of the fuse module housing 106. Such fuse state indication features may involve secondary fuse links or elements electrically connected in parallel with the primary fuse element in the fuse module 104.

A conductive line side fuse clip 110 may be situated within the disconnect housing 102 and may receive one of the terminal blades 108 of the fuse module 104. A conductive load side fuse clip 112 may also be situated within the disconnect housing 102 and may receive the other of the fuse terminal blades 108. The line and load side fuse clips 110, 112 may be biased with spring elements and the like to provide some resistance to the plug-in installation and removal of the respective terminal blades, and also to ensure sufficient contact force to ensure electrical connection therebetween when the terminal blades 108 are engaged.

The line side fuse clip 110 may be electrically connected to a first line side terminal 114 provided in the disconnect housing 102, and the first line side terminal 114 may include a stationary switch contact 116. The load side fuse clip 112 may be electrically connected to a load side connection terminal 118. In the example shown, the load side connection terminal 118 is a box lug terminal operable with a screw 120 to clamp or release an end of a connecting wire to establish electrical connection with load side electrical circuitry. Other types of load side connection terminals are known, however, and may be provided in alternative embodiments.

A rotary switch actuator 122 is further provided in the disconnect housing 102, and is mechanically coupled to an actuator link 124 that, in turn, is coupled to a sliding actuator bar 126. The actuator bar 126 carries a pair of switch contacts 128 and 130. In an exemplary embodiment, the switch actuator 122, the link 124 and the actuator bar 126 may be fabricated from nonconductive materials such as plastic. A second conductive line side terminal 132 including a stationary contact 134 is also provided, and a line side connecting terminal 135 is also provided in the disconnect housing 102. In the example shown, the line side connection terminal 135 is a box lug terminal operable with a screw 136 to clamp or release an end of a connecting wire to establish electrical connection with line side electrical circuitry. Other types of line side connection terminals are known, however, and may be provided in alternative embodiments. While in the illustrated embodiment the line side connecting terminal 135 and the load side connecting terminal 118 are of the same type (i.e., both are box lug terminals), it is contemplated that different types of connection terminals could be provided on the line and load sides of the disconnect housing 102 if desired.

Electrical connection of the device 100 to power supply circuitry, sometimes referred to as the line side, may be accomplished in a known manner using the line side connecting terminal 135. Likewise, electrical connection to load side circuitry may be accomplished in a known manner using the load side connecting terminal 118. As mentioned previously, a variety of connecting techniques are known (e.g., spring clamp terminals and the like) and may alternatively be utilized to provide a number of different options to make the electrical connections in the field. The configuration of the connecting terminals 135 and 118 accordingly are exemplary only.

In the position shown in FIG. 1, the disconnect device 100 is shown in the closed position with the switch contacts 130 and 128 mechanically and electrically engaged to the stationary contacts 134 and 116, respectively. As such, when the device 100 is connected to line side circuitry with a first connecting wire via the line side connecting terminal 135, and also when the load side terminal 118 is connected to load side circuitry with a connecting wire via the connecting terminal 118, a circuit path is completed through conductive elements in the disconnect housing 102 and the fuse module 104 when the fuse module 104 is installed and when the primary fuse element therein is in a non-opened, current carrying state.

Specifically, electrical current flow through the device 100 is as follows when the switch contacts 128 and 130 are closed, when the device 100 is connected to line and load side circuitry, and when the fuse module 104 is installed. Electrical current flows from the line side circuitry through the line side connecting wire to and through the line side connecting terminal 135. From the line side connecting terminal 135 current then flows to and through the second line terminal 132 and to the stationary contact 134. From the stationary contact 134 current flows to and through the switch contact 130, and from the switch contact 130 current flows to and through the switch contact 128. From the switch contact 128 current flows to and through the stationary contact 116, and from the stationary contact 116 current flows to and through the first line side terminal 114. From the first line side terminal 114 current flows to and through the line side fuse clip 112, and from the line side fuse clip 112 current flows to and through the first mating fuse terminal blade 108. From the first terminal blade 108 current flows to and through the primary fuse element in the fuse module 104, and from the primary fuse element to and through the second fuse terminal blade 108. From the second terminal blade 108 current flows to and through the load side fuse clip 112, and from the load side fuse clip 112 to and through the load side connecting terminal 118. Finally, from the connecting terminal 118 current flows to the load side circuitry via the wire connected to the terminal 118. As such, a circuit path or current path is established through the device 100 that includes the fuse element of the fuse module 104.

In the example shown, disconnect switching to temporarily open the current path in the device 100 may be accomplished in multiple ways. First, and as shown in FIG. 1, a portion of the switch actuator 122 projects through an upper surface of the disconnect housing 102 and is therefore accessible to be grasped for manual manipulation by a person. Specifically, the switch actuator 122 may be rotated from a closed position as shown in FIG. 1 to an open position in the direction of arrow A, causing the actuator link 124 to move the sliding bar 126 linearly in the direction of arrow B and moving the switch contacts 130 and 128 away from the stationary contacts 134 and 116. Eventually, the switch contacts 130 and 128 become mechanically and electrically disengaged from the stationary contacts 134 and 116 and the circuit path between the first and second line terminals 114 and 132, which includes the primary fusible element of the fuse module 104, may be opened via the separation of the switch contacts 130 and 128 when the fuse terminal blades 108 are received in the line and load side fuse clips 110 and 112.

When the circuit path in the device 100 is opened in such a manner via rotational displacement of the switch actuator 122, the fuse module 104 becomes electrically disconnected from the first line side terminal 132 and the associated line side connecting terminal 135. In other words, an open circuit is established between the line side connecting terminal 135 and the first terminal blade 108 of the fuse module 104 that is received in the line side fuse clip 110. The operation of switch actuator 122 and the displacement of the sliding bar 126 to separate the contacts 130 and 128 from the stationary contacts 134 and 116 may be assisted with bias elements such as springs. Particularly, the sliding bar 126 may be biased toward the open position wherein the switch contacts 130 and 128 are separated from the contacts 134 and 136 by a predetermined distance. The dual switch contacts 130 and 128 mitigate electrical arcing concerns as the switch contacts 134 and 116 are engaged and disengaged.

Once the switch actuator 122 of the disconnect device 100 is switched open to interrupt the current path in the device 100 and disconnect the fuse module 104, the current path in the device 100 may be closed to once again complete the circuit path through the fuse module 104 by rotating the switch actuator 122 in the opposite direction indicated by arrow C in FIG. 1. As the switch actuator 122 rotates in the direction of arrow C, the actuator link 124 causes the sliding bar 126 to move linearly in the direction of arrow D and bring the switch contacts 130 and 128 toward the stationary contacts 134 and 114 to close the circuit path through the first and second line terminals 114 and 132. As such, by moving the actuator 122 to a desired position, the fuse module 104 and associated load side circuitry may be connected and disconnected from the line side circuitry while the line side circuitry remains "live" in an energized, full power condition. Alternatively stated, by rotating the switch actuator 122 to separate or join the switch contacts, the load side circuitry may be electrically isolated from the line side circuitry, or electrically connected to the line side circuitry on demand. While the switch actuator 122 and associated switching components is desirable in many applications, it is contemplated that the switch actuator 122 and related switching components may in some embodiments be considered optional and may be omitted.

Additionally, the fuse module 104 may be simply plugged into the fuse clips 110, 112 or extracted therefrom to install or remove the fuse module 104 from the disconnect housing 102. The fuse housing 106 projects from the disconnect housing 102 and is open and accessible from an exterior of the disconnect housing 102 so that a person simply can grasp the fuse housing 106 by hand and pull or lift the fuse module 104 in the direction of arrow B to disengage the fuse terminal blades 108 from the line and load side fuse clips 110 and 112 until the fuse module 104 is completely released from the disconnect housing 102. An open circuit is established between the line and load side fuse clips 110 and 112 when the terminal blades 108 of the fuse module 104 are removed as the fuse module 104 is released, and the circuit path between the fuse clips 110 and 112 is completed when the fuse terminal blades 108 are engaged in the fuse clips 110 and 112 when the fuse module 104 is installed. Thus, via insertion and removal of the fuse module 104, the circuit path through the device 100 can be opened or closed apart from the position of the switch contacts as described above.

Of course, the primary fuse element in the fuse module 104 provides still another mode of opening the current path through the device 100 when the fuse module 104 is installed in response to actual current conditions flowing through the fuse element. As noted above, however, if the primary fuse element in the fuse module 104 opens, it does so permanently and the only way to restore the complete current path through the device 100 is to replace the fuse module 104 with another one having a non-opened fuse element. As such, and for discussion purposes, the opening of the fuse element in the fuse module 104 is permanent in the sense that the fuse module 104 cannot be reset to once again complete the current path through the device. Mere removal of the fuse module 104, and also displacement of the switch actuator 122 as described, are in contrast considered to be temporary events and are resettable to easily complete the current path and restore full operation of the affected circuitry by once again installing the fuse module 104 and/or closing the switch contacts.

The fuse module 104, or a replacement fuse module, can be conveniently and safely grasped by hand via the fuse module housing 106 and moved toward the switch housing 102 to engage the fuse terminal blades 108 to the line and load side fuse clips 110 and 112. The fuse terminal blades 108 are extendable through openings in the disconnect housing 102 to connect the fuse terminal blades 108 to the fuse clips 110 and 112. To remove the fuse module 104, the fuse module housing 106 can be grasped by hand and pulled from the disconnect housing 102 until the fuse module is completely released. As such, the fuse module 104 having the terminal blades 108 may be rather simply and easily plugged into the disconnect housing 102 and the fuse clips 110, 112, or unplugged as desired.

Such plug-in connection and removal of the fuse module 104 advantageously facilitates quick and convenient installation and removal of the fuse module 104 without requiring separately supplied fuse carrier elements common to some conventional fusible disconnect devices. Further plug-in connection and removal of the fuse module 104 does not require conventional tools (e.g., screwdrivers and wrenches) and associated fasteners (e.g., screws, nuts and bolts) common to other known fusible disconnect devices. Also, the fuse terminal blades 108 extend through and outwardly project from a common side of the fuse module body 106, and in the example shown the terminal blades 108 each extend outwardly from a lower side of the fuse housing 106 that faces the disconnect housing 102 as the fuse module 104 is mated to the disconnect housing 102.

In the exemplary embodiment shown, the fuse terminal blades 108 extending from the fuse module body 106 are generally aligned with one another and extend in respective spaced-apart parallel planes. It is recognized, however, that the terminal blades 108 of the module 106 in various other embodiments may be staggered or offset from one another, need not extend in parallel planes, and can be differently dimensioned or shaped. The shape, dimension, and relative orientation of the terminal blades 108, and the receiving fuse clips 110 and 112 in the disconnect housing 102 may serve as fuse rejection features that only allow compatible fuses to be used with the disconnect housing 102. In any event, because the terminal blades 108 project away from the lower side of the fuse housing 106, a person's hand when handling the fuse module housing 106 for plug in installation (or removal) is physically isolated from the terminal blades 108 and the conductive line and load side fuse clips 110 and 112 that receive the terminal blades 108 as mechanical and electrical connections therebetween are made and broken.

The fuse module 104 is therefore touch safe (i.e., may be safely handled by hand to install and remove the fuse module 104 without risk of electrical shock).

The disconnect device 100 is rather compact and occupies a reduced amount of space in an electrical power distribution system including the line side circuitry and the load side circuitry than other known fusible disconnect devices and arrangements providing similar effect. In the embodiment illustrated in FIG. 1 the disconnect housing 102 is provided with a DIN rail slot 150 that may be used to securely mount the disconnect housing 102 in place with snap-on installation to a DIN rail by hand and without tools. The DIN rail may be located in a cabinet or supported by other structure, and because of the smaller size of the device 100, a greater number of devices 100 may be mounted to the DIN rail in comparison to conventional fusible disconnect devices.

In another embodiment, the device 100 may be configured for panel mounting by replacing the line side terminal 135, for example, with a panel mounting clip. When so provided, the device 100 can easily occupy less space in a fusible panelboard assembly, for example, than conventional in-line fuse and circuit breaker combinations. In particular, CUBE-Fuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use of the exemplary device 100 as shown, the circuit path or current path through the device 100 is preferably connected and disconnected at the switch contacts 134, 130, 128, 116 rather than at the fuse clips 110 and 112. By doing so, electrical arcing that may occur when connecting/disconnecting the circuit path may be contained at a location away from the fuse clips 110 and 112 to provide additional safety for persons installing, removing, or replacing fuses. By opening the switch contacts with the switch actuator 122 before installing or removing the fuse module 104, any risk posed by electrical arcing or energized conductors at the fuse and disconnect housing interface is eliminated. The disconnect device 100 is accordingly believed to be safer to use than many known fused disconnect switches.

The disconnect switching device 100 includes still further features, however, that improve the safety of the device 100 in the event that a person attempts to remove the fuse module 104 without first operating the actuator 122 to disconnect the circuit through the fuse module 104, and also to ensure that the fuse module 104 is compatible with the remainder of the device 100. That is, features are provided to ensure that the rating of the fuse module 104 is compatible with the rating of the conductive components in the disconnect housing 102.

As shown in FIG. 1, the disconnect housing 102 in one example includes an open ended receptacle or cavity 152 on an upper edge thereof that accepts a portion of the fuse housing 106 when the fuse module 104 is installed with the fuse terminal blades 108 engaged to the fuse clips 110, 112. The receptacle 152 is shallow in the embodiment depicted, such that a relatively small portion of the fuse housing 106 is received when the terminal blades 108 are plugged into the disconnect housing 102. A remainder of the fuse housing 106, however, generally projects outwardly from the disconnect housing 102 allowing the fuse module housing 106 to be easily accessed and grasped with a user's hand and facilitating a finger safe handling of the fuse module 104 for installation and removal without requiring conventional tools. It is understood, however, that in other embodiments the fuse housing 106 need not project as greatly from the switch housing receptacle when installed as in the embodiment depicted, and indeed could even be substantially entirely contained within the switch housing 102 if desired.

In the exemplary embodiment shown in FIG. 1, the fuse housing 106 includes a recessed guide rim 154 having a slightly smaller outer perimeter than a remainder of the fuse housing 106, and the guide rim 154 is seated in the switch housing receptacle 152 when the fuse module 104 is installed. It is understood, however, that the guide rim 154 may be considered entirely optional in another embodiment and need not be provided. The guide rim 154 may in whole or in part serve as a fuse rejection feature that would prevent someone from installing a fuse module 104 having a rating that is incompatible with the conductive components in the disconnect housing 102. Fuse rejection features could further be provided by modifying the terminal blades 108 in shape, orientation, or relative position to ensure that a fuse module having an incompatible rating cannot be installed.

In contemplated embodiments, the base of the device 100 (i.e., the disconnect housing 102 and the conductive components therein) has a rating that is ½ of the rating of the fuse module 104. Thus, for example, a base having a current rating of 20 A may preferably be used with a fuse module 104 having a rating of 40 A. Ideally, however, fuse rejection features such as those described above would prevent a fuse module of a higher rating, such as 60 A, from being installed in the base. The fuse rejection features in the disconnect housing 102 and/or the fuse module 104 can be strategically coordinated to allow a fuse of a lower rating (e.g., a fuse module having a current rating of 20 A) to be installed, but to reject fuses having higher current ratings (e.g., 60 A and above in the example being discussed). It can therefore be practically ensured that problematic combinations of fuse modules and bases will not occur. While exemplary ratings are discussed above, they are provided for the sake of illustration rather than limitation. A variety of fuse ratings and base ratings are possible, and the base rating and the fuse module rating may vary in different embodiments and in some embodiments the base rating and the fuse module rating may be the same.

As a further enhancement, the disconnect housing 102 includes an interlock element 156 that frustrates any effort to remove the fuse module 104 while the circuit path through the first and second line terminals 132 and 114 via the switch contacts 134, 130, 128, 116 is closed. The exemplary interlock element 156 shown includes an interlock shaft 158 at a leading edge thereof, and in the locked position shown in FIG. 1 the interlock shaft 158 extends through a hole in the first fuse terminal blade 108 that is received in the line side fuse clip 110. Thus, as long as the projecting interlock shaft 158 is extended through the opening in the terminal blade 108, the fuse module 104 cannot be pulled from the fuse clip 110 if a person attempts to pull or lift the fuse module housing 106 in the direction of arrow B. As a result, and because of the interlock element 156, the fuse terminal blades 108 cannot be removed from the fuse clips 110 and 112 while the switch contacts 128, 130 are closed and potential electrical arcing at the interface of the fuse clips 110 and 112 and the fuse terminal blades 108 is avoided. Such an interlock element 156 is believed to be beneficial for the reasons stated but could be considered optional in certain embodiments and need not be utilized.

The interlock element 156 is coordinated with the switch actuator 122 so that the interlock element 156 is moved to an unlocked position wherein the first fuse terminal blade 108 is released for removal from the fuse clip 110 as the switch actuator 122 is manipulated to open the device 100. More specifically, a pivotally mounted actuator arm 160 is provided in the disconnect housing 102 at a distance from the switch actuator 122, and a first generally linear mechanical link 162 interconnects the switch actuator 122 with the arm 160. The pivot points of the switch actuator 122 and the arm 160 are nearly aligned in the example shown in FIG. 1, and as the switch actuator 122 is rotated in the direction of arrow A, the link 162 carried on the switch actuator 122 simultaneously rotates and causes the arm 160 to rotate similarly in the direction of arrow E. As such, the switch actuator 122 and the arm 160 are rotated in the same rotational direction at approximately the same rate.

A second generally linear mechanical link 164 is also provided that interconnects the pivot arm 160 and a portion of the interlock element 156. As the arm 160 is rotated in the direction of arrow E, the link 164 is simultaneously displaced and pulls the interlock element 156 in the direction of arrow F, causing the projecting shaft 158 to become disengaged from the first terminal blade 108 and unlocking the interlock element 156. When so unlocked, the fuse module 104 can then be freely removed from the fuse clips 110 and 112 by lifting on the fuse module housing 106 in the direction of arrow B. The fuse module 104, or perhaps a replacement fuse module 104, can accordingly be freely installed by plugging the terminal blades 108 into the respective fuse clips 110 and 112.

As the switch actuator 122 is moved back in the direction of arrow C to close the disconnect device 100, the first link 162 causes the pivot arm 160 to rotate in the direction of arrow G, causing the second link 164 to push the interlock element 156 in the direction of arrow H until the projecting shaft 158 of the interlock element 156 again passes through the opening of the first terminal blade 108 and assumes a locked position with the first terminal blade 108. As such, and because of the arrangement of the arm 160 and the links 162 and 164, the interlock element 156 is slidably movable within the disconnect housing 102 between locked and unlocked positions. This slidable movement of the interlock element 156 occurs in a substantially linear and axial direction within the disconnect housing 102 in the directions of arrow F and H in FIG. 1.

In the example shown, the axial sliding movement of the interlock element 156 is generally perpendicular to the axial sliding movement of the actuator bar 126 that carries the switchable contacts 128 and 130. In the plane of FIG. 1, the movement of the interlock element 156 occurs along a substantially horizontal axis, while the movement of the sliding bar 126 occurs along a substantially vertical axis. The vertical and horizontal actuation of the sliding bar 126 and the interlock element 156, respectively, contributes to the compact size of the resultant device 100, although it is contemplated that other arrangements are possible and could be utilized to mechanically move and coordinate positions of the switch actuator 122, the switch sliding bar 126 and the interlock element 156. Also, the interlock element 156 may be biased to assist in moving the interlock element to the locked or unlocked position as desired, as well as to resist movement of the switch actuator 122, the sliding bar 126 and the interlock element 156 from one position to another. For example, by biasing the switch actuator 122 to the opened position to separate the switch contacts, either directly or indirectly via bias elements acting upon the sliding bar 126 or the interlock element 156, inadvertent closure of the switch actuator 122 to close the switch contacts and complete the current path may be largely, if not entirely frustrated, because once the switch contacts are opened a person must apply a sufficient force to overcome the bias force and move the switch actuator 122 back to the closed position shown in FIG. 1 to reset the device 100 and again complete the circuit path. If sufficient bias force is present, it can be practically ensured that the switch actuator 122 will not be moved to close the switch via accidental or inadvertent touching of the switch actuator 122.

The interlock element 156 may be fabricated from a nonconductive material such as plastic according to known techniques, and may be formed into various shapes, including but not limited to the shape depicted in FIG. 1. Rails and the like may be formed in the disconnect housing 102 to facilitate the sliding movement of the interlock element 156 between the locked and unlocked positions.

The pivot arm 160 is further coordinated with a tripping element 170 for automatic operation of the device 100 to open the switch contacts 128, 130. That is, the pivot arm 160, in combination a tripping element actuator described below, and also in combination with the linkage 124, 162, and 164 define a tripping mechanism to force the switch contacts 128, 130 to open independently from the action of any person. Operation of the tripping mechanism is fully automatic, as described below, in response to actual circuit conditions, as opposed to the manual operation of the switch actuator 122 described above. Further, the tripping mechanism is multifunctional as described below to not only open the switch contacts, but to also to displace the switch actuator 122 and the interlock element 156 to their opened and unlocked positions, respectively. The pivot arm 160 and associated linkage may be fabricated from relatively lightweight nonconductive materials such as plastic.

In the example shown in FIG. 1, the tripping element actuator 160 is an electromagnetic coil such as a solenoid having a cylinder or pin 172, sometimes referred to as a plunger, that is extendable or retractable in the direction of arrow F and H along an axis of the coil. The coil when energized generates a magnetic field that causes the cylinder or pin 172 to be displaced. The direction of the displacement depends on the orientation of the magnetic field generated so as to push or pull the plunger cylinder or pin 172 along the axis of the coil. The plunger cylinder or pin 172 may assume various shapes (e.g., may be rounded, rectangular or have other geometric shape in outer profile) and may be dimensioned to perform as hereinafter described.

In the example shown in FIG. 1, when the plunger cylinder or pin 172 is extended in the direction of arrow F, it mechanically contacts a portion of the pivot arm 160 and causes rotation thereof in the direction of arrow E. As the pivot arm 160 rotates, the link 162 is simultaneously moved and causes the switch actuator 122 to rotate in the direction of arrow A, which in turn pulls the link 124 and moves the sliding bar 126 to open the switch contacts 128, 130. Likewise, rotation of the pivot arm 160 in the direction of arrow E simultaneously causes the link 164 to move the interlock element 156 in the direction of arrow F to the unlocked position.

It is therefore seen that a single pivot arm 160 and the linkage 162 and 164 mechanically couples the switch actuator 122 and the interlock element 156 during normal operation of the device, and also mechanically couples the switch actuator 122 and the interlock element 156 to the tripping element 170 for automatic operation of the device. In the exemplary embodiment shown, an end of the link 124 connecting the switch actuator 122 and the sliding bar 126 that carries the switch contacts 128, 130 is coupled to the switch actuator 122 at approximately a common location as the end of the link 162, thereby ensuring that when the tripping element 170 operates to pivot the arm 160, the link 162 provides a dynamic force to the switch actuator 122 and the link 124 to ensure an efficient separation of the contacts 128 and 130 with a reduced amount of mechanical force than may otherwise be necessary. The tripping element actuator 170 engages the pivot arm 160 at a good distance from the pivot point of the arm 160 when mounted, and the resultant mechanical leverage provides sufficient mechanical force to overcome the static equilibrium of the mechanism when the switch contacts are in the opened or closed position. A compact and economical, yet highly effective tripping mechanism is therefore provided. Once the tripping mechanism operates, it may be quickly and easily reset by moving the switch actuator 122 back to the closed position that closes the switch contacts.

Suitable solenoids are commercially available for use as the tripping actuator element 170. Exemplary solenoids include LEDEX® Box Frame Solenoid Size B17M of Johnson Electric Group (www.ledex.com) and ZHO-0520 L/S Open Frame Solenoids of Zohnen Electric Appliances (www.zonhen.com). In different embodiments, the solenoid 170 may be configured to push the arm 160 and cause it to rotate, or to pull the contact arm 160 and cause it to rotate. That is, the tripping mechanism can be operated to cause the switch contacts to open with a pushing action on the pivot arm 160 as described above, or with a pulling action on the pivot arm 160. Likewise, the solenoid could operate on elements other than the pivot arm 160 if desired, and more than one solenoid could be provided to achieve different effects.

In still other embodiments, it is contemplated that actuator elements other than a solenoid may suitably serve as a tripping element actuator to achieve similar effects with the same or different mechanical linkage to provide comparable tripping mechanisms with similar benefits to varying degrees. Further, while simultaneous actuation of the components described is beneficial, simultaneous activation of the interlock element 156 and the sliding bar 126 carrying the switch contacts 128, 130 may be considered optional in some embodiments and these components could accordingly be independently actuated and separately operable if desired. Different types of actuator could be provided for different elements.

Moreover, in the embodiment shown the trip mechanism is entirely contained within the disconnect housing 102 while still providing a relatively small package size. It is recognized, however, that in other embodiments the tripping mechanism may in whole or in part reside outside the disconnect housing 102, such as in separately provided modules that may be joined to the disconnect housing 102. As such, in some embodiments, the trip mechanism could be, at least in part, considered an optional add-on feature provided in a module to be used with the disconnect housing 102. Specifically, the trip element actuator and linkage in a separately provided module may be mechanically linked to the switch actuator 122, the pivot arm 160 and/or the sliding bar 126 of the disconnect housing 102 to provide comparable functionality to that described above, albeit at greater cost and with a larger overall package size.

The tripping element 170 and associated mechanism may further be coordinated with a detection element and control circuitry to automatically move the switch contacts 128, 130 to the opened position when predetermined electrical conditions occur. In one exemplary embodiment, the second line terminal 132 is provided with an in-line detection element 180 that is monitored by control circuitry 190. As such, actual electrical conditions can be detected and monitored in real time and the tripping element 170 can be intelligently operated to open the circuit path in a proactive manner independent of operation of the fuse module 104 itself and/or any manual displacement of the switch actuator 122. That is, by sensing, detecting and monitoring electrical conditions in the line terminal 132 with the detection element 180, the switch contacts 128, 130 can be automatically opened with the tripping element 170 in response to predetermined electrical conditions that are potentially problematic for either of the fuse module 104 or the base assembly (i.e., the disconnect housing 102 and its components).

In particular, the control circuitry 190 may open the switch contacts in response to conditions that may otherwise, if allowed to continue, cause the primary fuse element in the fuse module 104 to permanently open and interrupt the electrical circuit path between the fuse terminals 108. Such monitoring and control may effectively prevent the fuse module 104 from opening altogether in certain conditions, and accordingly save it from having to be replaced, as well as providing notification to electrical system operators of potential problems in the electrical power distribution system. Beneficially, if permanent opening of the fuse is avoided via proactive management of the tripping mechanism, the device 100 becomes, for practical purposes, a generally resettable device that may in many instances avoid any need to locate a replacement fuse module, which may or may not be readily available if needed, and allow a much quicker restoration of the circuitry than may otherwise be possible if the fuse module 104 has to be replaced. It is recognized, however, that if certain circuit conditions were to occur, permanent opening of the fuse 104 may be unavoidable.

Figure 7:
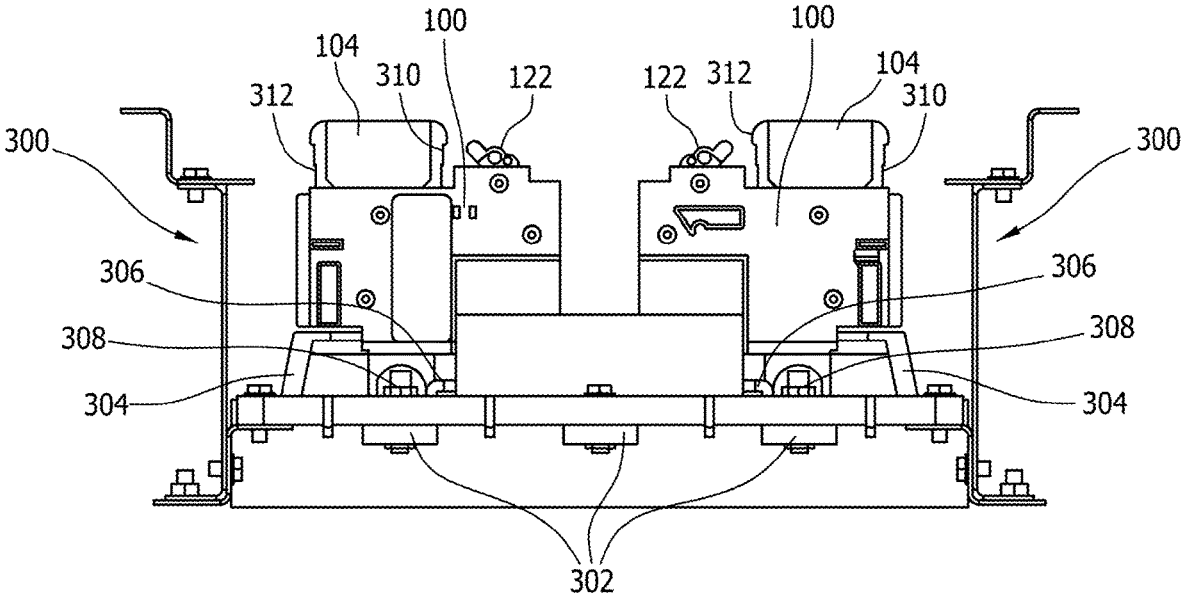
FIG. 7 is an end elevational view of fusible switching disconnect devices mounted to a panelboard.

As mentioned above, the fuse modules 104 sometimes can be difficult to remove from the disconnect device 100 by hand, especially when a number of disconnect devices 100 are arranged side-by-side such that physical access to grasp the fuse module 104 with ones fingers is limited. One exemplary installation wherein such access may be restricted is a panelboard installation of the devices 100. For example, FIG. 7 shows a portion of a panelboard chassis assembly including a pair of support rails 300, a ground bar, a neutral bar, and multiple hot bus bars 302. In operation, the live power flows through a main service disconnect device of the panelboard assembly to each of the hot bus bars 302. The hot bus bars 302 provide, in turn power to each of the branch circuits provided in the panelboard assembly via the fusible switching disconnect devices 100 and fuse modules 104.

As also shown in FIG. 7, each fusible switching disconnect device 100 is mounted to a mounting support 304 coupled to one of the support rails 300, and a branch connector 306 coupled to one or more of the hot bus bars 302 and establishing electrical connection therewith at a connection point 308. In alternative exemplary embodiments, each fusible disconnect device 100 may be mounted directly to the support rails 300 and/or the hot bus bar(s) 302.

Figure 8:
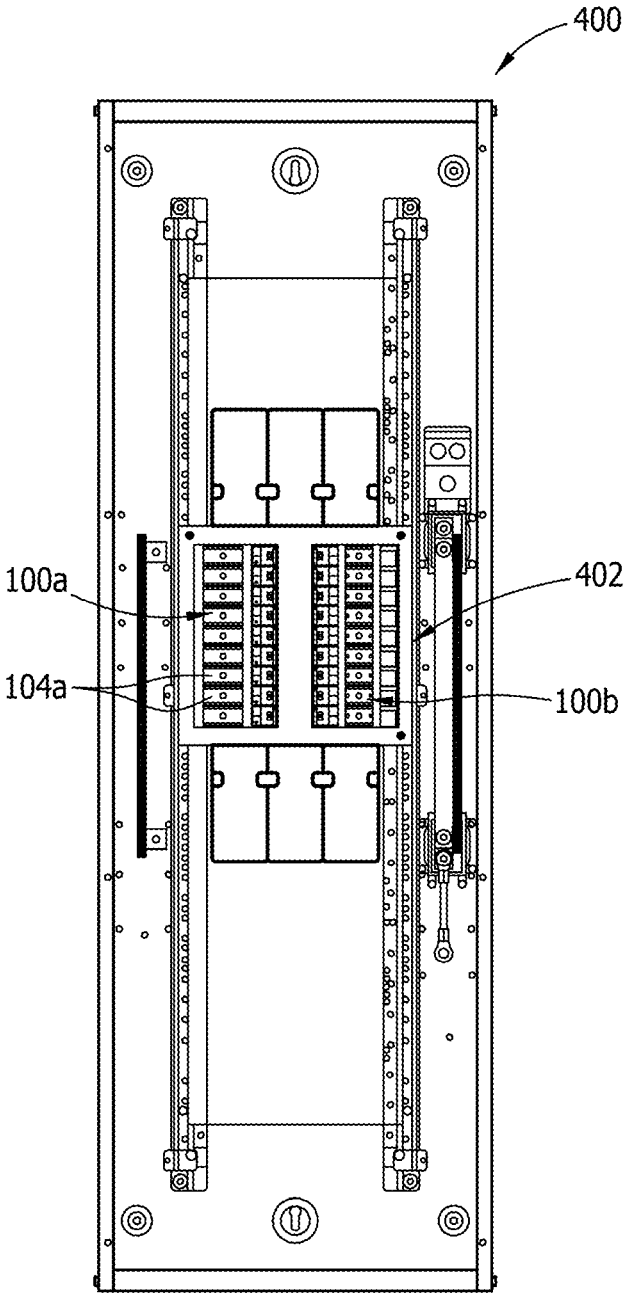
FIG. 8 is a front elevational view of a panelboard including fusible switching disconnect devices.

FIG. 8 illustrates a panelboard assembly 400 including the chassis assembly 300 shown in FIG. 7, a configurable branch enclosure cover 402 and fusible switching disconnect devices 100*a*, 100*b* installed to the fusible panelboard assembly 400. The fusible switching disconnect devices 100*a* and 100*b* are essentially similar devices having different ratings and therefore accepting different sizes of the fuse modules 104. In the example shown, the devices 100*a* have a relatively larger amperage rating and include relative larger fuse modules 104*a* (e.g., a CUBEFuse™ having a 100

A rating), while the devices 100*b* have a relatively smaller rating and include relative smaller fuse modules 104*a* (e.g., a CUBEFuse™ having a 60 A or 30 A rating). Further details regarding the panelboard assembly may be found in the commonly owned U.S. patent application Ser. No. 12/691,344 filed Jan. 21, 2010 (now issued U.S. Pat. No. 8,134,828), the disclosure of which is hereby incorporated by reference in its entirety.

As can be seen in FIG. 8, the fuse modules 104*a*, 104*b* are arranged side-by-side in a compact arrangement with little clearance between them. As can be seen in FIG. 7, the switch actuators 122 of the devices 100 can be an obstacle to gripping the adjacent side of the fuse module 104 with one's fingers. As such, and as seen in FIG. 7, grasping the lateral sides 310 and 312 of the fuse modules 104 with one's thumb and forefinger for example, and also pulling the fuse module 104 away from the disconnect housing with sufficient force to release it can become challenging for some users. The force required to pull the fuse module 104 from the disconnect housing of the respective device 100 may be sufficiently great that certain persons may have difficulty removing one of more of the fuse modules 104 from the panelboard assembly 400 (FIG. 8).

Figure 2:
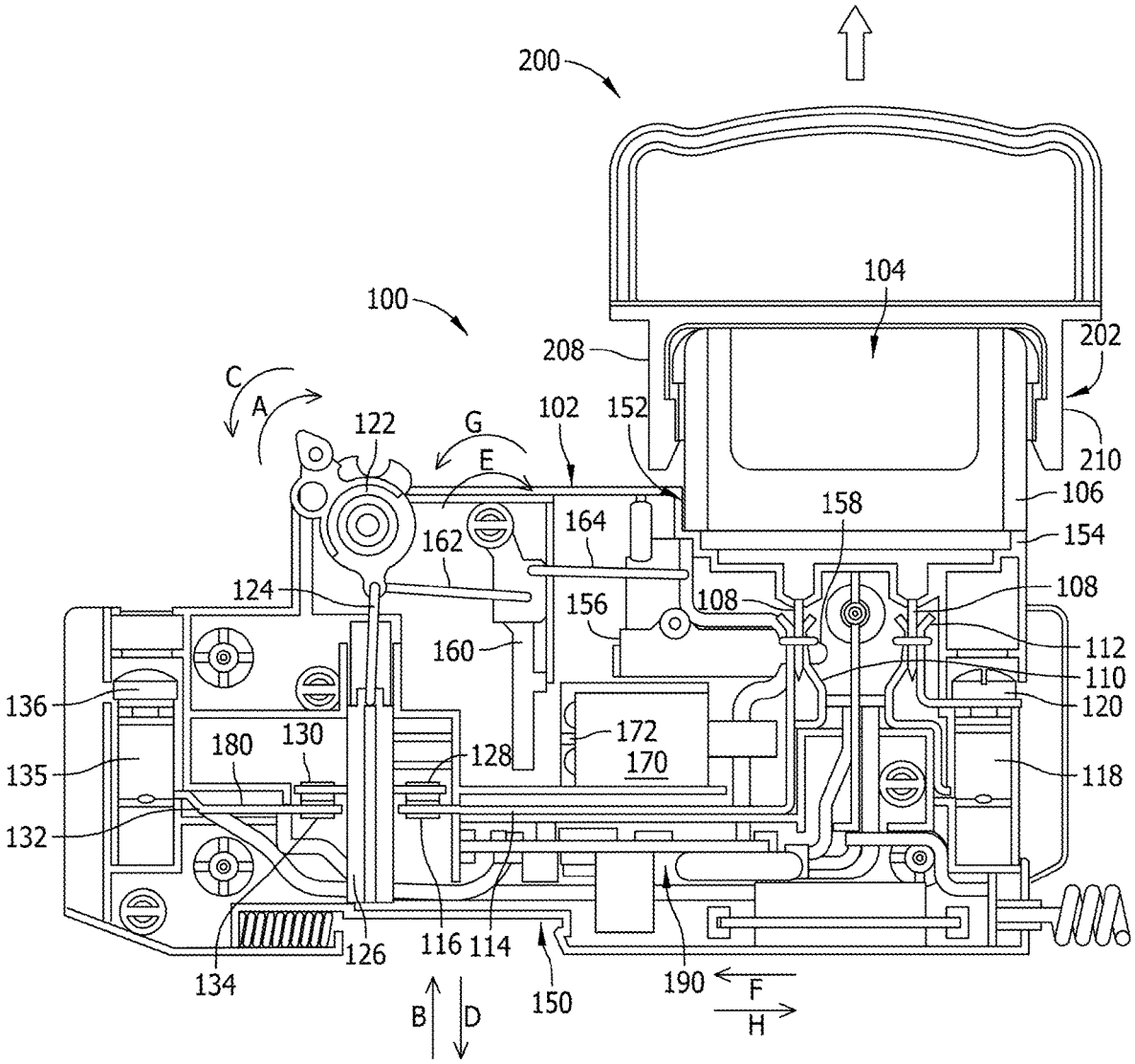
FIG. 2 is another side elevational view of the fusible switching disconnect device shown in FIG. 1 with the accessory coupled to the fuse.
Figure 3:
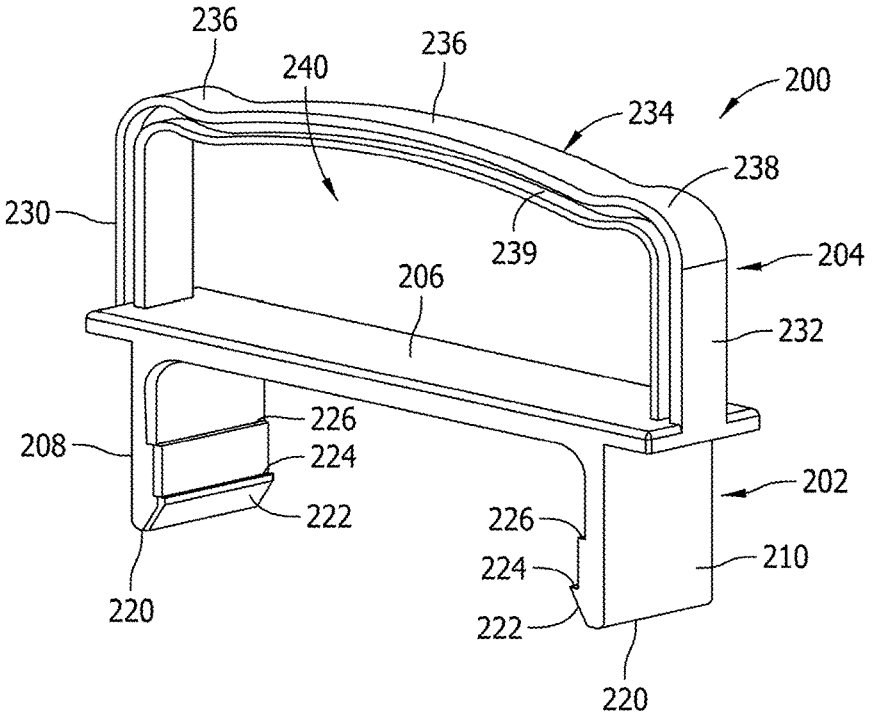
FIG. 3 illustrates the accessory shown in FIGS. 1 and 2 in perspective view.

Referring back to FIGS. 1 and 2, and also FIG. 3 illustrating the removal tool accessory 200 in perspective view, the removal tool accessory 200 greatly facilitates a more convenient removal of a fuse module 104 from the device 100 when desired. The removal tool accessory 200 requires minimal physical access proximate the exterior of the fuse module 104, while providing increased mechanical leverage to pull the fuse module 104 from the disconnect housing 102 when necessary. FIG. 1 shows the removal tool accessory 200 being engaged to the fuse module 104, and FIG. 2 shown the removal tool accessory 200 engaged to the fuse module 104. The removal tool accessory 200 is installed by moving it downwardly over the top of the fuse module 104 as shown in FIG. 1, and once engaged the removal tool accessory 200 may be pulled from the disconnect housing 102 with the fuse module 104 attached. The removal tool accessory 200 may be snap-fit to the fuse module 104 and easily removed therefrom without requiring fastener tools (e.g., screwdrivers, wrenches and the like) and conventional fasteners (e.g., screws, bolts and nuts). By avoiding external fasteners such as screws, bolts and nuts, the tool accessory 104 allows fuse replacement more quickly than conventional fusible disconnect devices utilizing such fasteners to secure a fuse therein.

As shown in FIGS. 1 and 2, the removal tool accessory 200 generally includes a fuse engagement portion 202 and a hand grip portion 204 formed integrally with the fuse engagement portion 202. The fuse engagement portion 202 includes a cross bar 206 and downwardly depending arms 208, 210 extending generally perpendicular to the cross bar 204 and spaced from or inset from the opposing ends of the cross bar 206. The cross bar 206 and the depending arms 208, 210 collectively define a generally rectangular shaped, open faced cavity or receptacle 212 that receives a portion of the fuse module housing 106. Specifically, the receptacle 212 receives an upper or top surface 214 of the fuse module housing 106, and portions of the lateral sides 216, 218 of the fuse module housing when the removal tool accessory 200 is engaged as shown in FIGS. 1 and 2. That is, the cross bar 206 of the fuse engagement portion 202 generally spans the top surface 214 of the fuse module housing 106, and the depending arms 210, 212 of the removal tool accessory 200 receive exposed portions of the fuse module housing lateral sides 216, 218.

Figure 4:
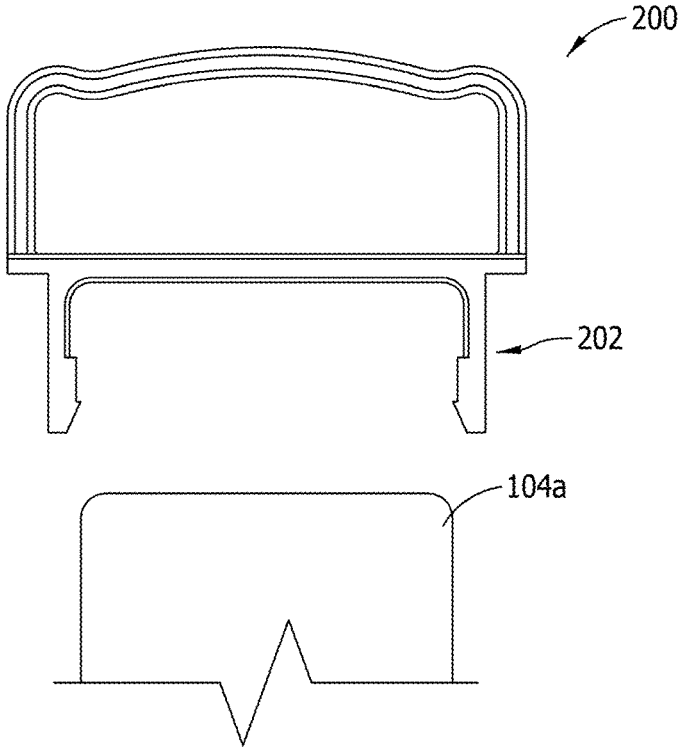
FIG. 4 is a front elevational view of the accessory shown in FIG. 3.

As shown in FIGS. 1 and 3-4, the interior facing surfaces of each depending arm 208, 210 in the example shown includes a generally wedge-shaped leading end 220 including a tapered guide surface 222, and retaining ledges 224, 226 spaced from one another and from each the leading end 220. The guide surfaces 222, as the removal tool accessory 200 is engaged to the fuse module housing 106, urges the depending arms 208, 210 to resiliently deflect away from one another and around the outer surface of the lateral sides 216, 218 of the fuse module housing 106. The retaining ledges 224, 226 positively engage projections seen on the lateral sides 216, 218 of the fuse module housing 106 as shown in FIGS. 1 and 2. Thus, with a snap-action fit, the fuse engagement portion 202 may be lockingly coupled to the fuse module 104.

The hand grip portion 204 of the removal tool accessory 200 includes upright arms 230, 232 extending upwardly from the cross bar 206 at the respective opposing ends thereof. A handlebar 234 extends above the cross bar 206 and interconnects the upright arms 230, 232. The upright arms 230, 232 and the handlebar 234 include a channel 239 on the opposing sides thereof. The channel 239 imparts an I-beam cross section to the upright arms 230, 232 and the handlebar 234 which allows material savings in the removal tool accessory 200 while providing a structurally sound part that is resistant to deflection. Thus, while the fuse engagement portion 202 of the removal tool accessory 200 is designed to resiliently deflect, the hand grip portion is not.

In the example shown, the handlebar 234 includes a bowed central section 236 including a convex curvature and transition sections 236, 238 on either side thereof including a concave curvature near the upright arms 230, 232. The bowed central section 236 provides a curved gripping surface for a user's fingers. Other configurations of the handlebar 234 are, of course possible and may be used in other embodiments.

The cross bar 206, the upright arms 230 and 232, and the handlebar 236 provide a second, closed faced opening, receptacle or cavity 240 above the fuse engagement portion 202 of the removal tool accessory 200. The cavity 240 provides sufficient room for a person to insert their index finger, middle finger, ring finger, and baby finger through the cavity 240. Once so inserted, the user may wrap their fingers around the handle bar 234 and grip the removal tool accessory 200 much more securely than the person could otherwise grip the fuse module 104 by hand. By comparison, without the removal tool accessory 200, when the fuse modules 104 are arranged side-by-side as shown in FIG. 8, a user is generally limited to gripping the lateral sides 216, 218 of the fuse module housing 106 with their thumb on one side and with the index and/or middle finger on the other side. This can be an awkward hand position from which to pull the fuse. In contrast, the four finger engagement provided by the handlebar 234 allows the person to grip the handle with their hand in a first configuration, facilitating a more natural pulling arrangement with optimal mechanical leverage to remove the fuse module 104 from the disconnect housing 102.

The removal tool accessory 200 may be fabricated from suitable materials known in the art, including but not limited to plastic materials in a relatively low cost manner. Further, the removal tool accessory is formed in an integral or single piece construction without moving parts. The removal tool accessory 200 therefore is more economical to manufacture, avoids reliability issues of conventional fuse puller devices having multi-piece constructions that pivot or rotate relative to one another to grip external surfaces of a fuse, and requires little operator skill to use.

As shown in FIG. 4 in front elevational view, the finger grip portion 202 of the removal tool accessory 200 is designed to engage a first rectangular fuse module 104*a* having a relatively high current rating. As one example, the fuse module 104*a* may be a CUBEFuse™ module having a 100 A rating.

Figure 5:
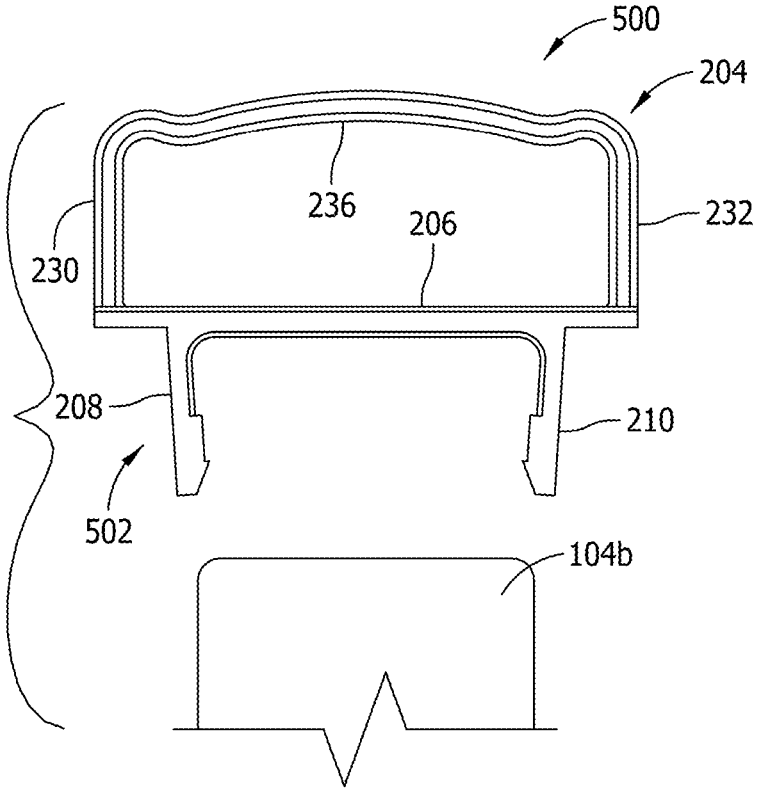
FIG. 5 is a front elevational view of another exemplary embodiment of an accessory for removing a fuse.

FIG. 5 illustrates another embodiment of a removal tool accessory 500 in front elevational view including a finger grip portion 502 of the removal tool accessory 200 is designed to engage a second rectangular fuse module 104*b* having an intermediate current rating. As one example, the fuse module 104*b* may be a CUBEFuse™ module having a 60 A rating. Because the fuse module 104*b* has a smaller physical size than the fuse module 104*a* (FIG. 4), the depending arms 208, 210 are inset further from the opposing ends of the cross bar 206 and are spaced closer apart to one another to define a smaller interior cavity to receive the fuse module 104*b*. The handle grip portion 204 in the removal tool accessory 500 is, however, unchanged.

Figure 6:
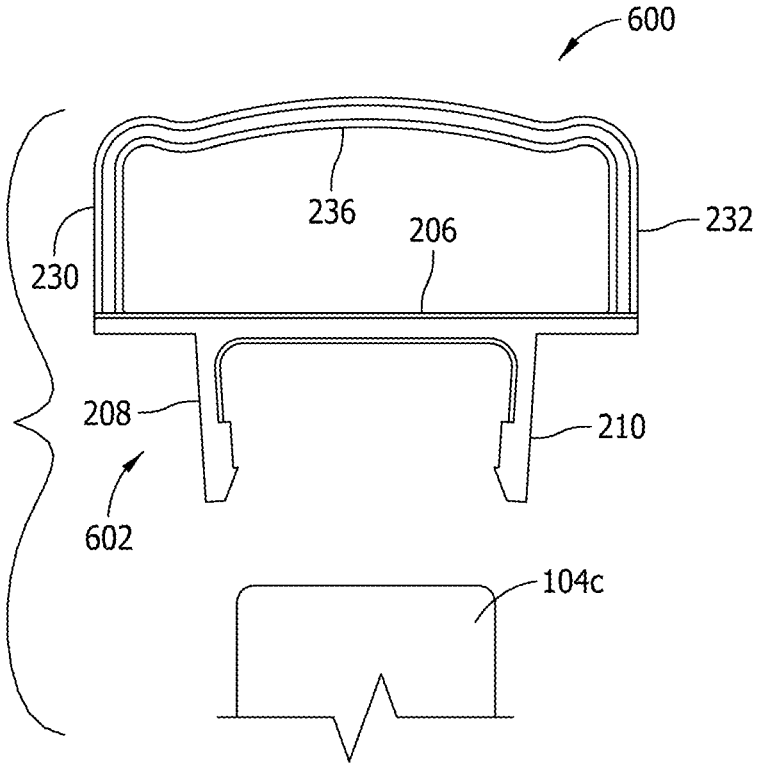
FIG. 6 is a front elevational view of another exemplary embodiment of an accessory for removing a fuse.

FIG. 6 illustrates another embodiment of a removal tool accessory 600 in front elevational view including a finger grip portion 602 of the removal tool accessory 200 is designed to engage a third rectangular fuse module 104*c* having a relatively small current rating. As one example, the fuse module 104*c* may be a CUBEFuse™ module having a 30 A rating. Because the fuse module 104*c* has a smaller physical size than the fuse module 104*b* (FIG. 5), the depending arms 208, 210 are inset further from the opposing ends of the cross bar 206 and are spaced closer apart to one another to define a smaller interior cavity to receive the fuse module 104*c*. The handle grip portion 204 in the removal tool accessory 600 is, however, unchanged.

Therefore, by selecting the appropriate one of the removal tool accessories 200, 500 and 600 differently sized fuse modules 104*a*, 104*b* and 104*c* may be removed and replaced from the disconnect devices 100, and specifically from the disconnect housings 102, with ease.

The removal tool accessories 200, 500 and 600 may be provided in kit form with the fuse modules 104*a*, 104*b* and 104*c*. As such, an end user can select the appropriate one of the fuse modules for use as a replacement fuse, and also select the appropriate removal tool accessory 200, 500 or 600 to effect the replacement. Otherwise, the removal tool accessories may be provided independently from the replacement fuses.

Different versions of disconnect devices 100 may also be provided in kit form together with the different fuse modules 104*a*, 104*b* and 104*c* and removal tool accessories 200, 500 and 600. Thus, the removal tool accessories 200, 500 and 600 may be packaged for sale with the disconnect housings 102 and fuse modules 104*a*, 104*b* and 104*c* that are compatible with the disconnect housings 102 provided.

The benefits and advantages of the inventive concepts disclosed is now believed to be apparent in relation to the exemplary embodiments disclosed.

An embodiment of a removal tool accessory for a rectangular fuse module of a fusible disconnect device has been disclosed. The rectangular fuse module includes a housing with opposing lateral sides and first and second terminal blades extending from a common side of the housing. The tool accessory includes: a fuse engaging portion comprising a cross bar and first and second depending arms extending from the crossbar, the first and second depending arms defining a cavity therebetween to receive the opposing lateral sides of the fuse module housing; and a handle grip portion integrally formed with the fuse engaging portion.

Optionally, the handle grip portion may include a pair of upright arms extending from the cross bar, and a handlebar extending between the pair of upright arms. The handlebar may include a section with convex curvature and a section with concave curvature. The handlebar, the pair of upright arms, and the cross bar may define an opening dimensioned to receive a person's index finger, middle finger, ring finger, and baby finger. The first and second depending arms may each include a pair of retention ledges. The first and second depending arms may be resiliently deflectable to engage the opposing lateral sides of the fuse module housing. The cross bar may include opposing first and second ends, and the first and second depending arms may be inset from the opposing first and second ends. The first and second depending arms may be configured to snap-fit with the rectangular fuse module.

An embodiment of an accessory kit for a fusible switch disconnect module has also been disclosed. The kit includes: at least one rectangular fuse module comprising a housing with opposing lateral sides and first and second terminal blades extending from a common side of the housing; and at least one removal tool accessory comprising: a fuse engaging portion comprising a cross bar and first and second depending arms extending from the crossbar, the first and second depending arms defining a cavity therebetween to receive the opposing lateral sides of the fuse module housing; and a handle grip portion integrally formed with the fuse engaging portion.

Optionally, the at least one rectangular fuse module may include a plurality of rectangular fuse modules respectively having different physical sizes and correspondingly different amperage ratings, and the at least one removal tool accessory may include a plurality of removal tool accessories each respectively configured to engage one of the plurality of rectangular fuse modules respectively having different physical sizes and correspondingly different amperage ratings. The handle grip portion may include a pair of upright arms extending from the cross bar, and a handlebar extending between the pair of upright arms. The handlebar may include a section with convex curvature and a section with concave curvature. The handlebar, the pair of upright arms, and the cross bar may define an opening dimensioned to receive a person's index finger, middle finger, ring finger, and baby finger. The first and second depending arms may each include a pair of retention ledges. The first and second depending arms may be resiliently deflectable to engage the opposing lateral sides of the fuse module housing. The cross bar may include opposing first and second ends, and the first and second depending arms may be inset from the opposing first and second ends. The first and second depending arms may be configured to snap-fit with the rectangular fuse module.

An embodiment of a fusible switch disconnect device system has also been disclosed. The system comprises: a disconnect housing; a rectangular fuse module comprising a housing with opposing lateral sides and first and second terminal blades extending from a common side of the housing; and at least one removal tool accessory comprising: a fuse engaging portion comprising a cross bar and first and second depending arms extending from the crossbar, the first and second depending arms defining a cavity therebetween to receive the opposing lateral sides of the fuse module housing; and a handle grip portion integrally formed with the fuse engaging portion.

Optionally, the handle grip portion may include a pair of upright arms extending from the cross bar, and a handlebar extending between the pair of upright arms. The handlebar may include a section with convex curvature and a section with concave curvature. The handlebar, the pair of upright arms, and the cross bar may define an opening dimensioned to receive a person's index finger, middle finger, ring finger, and baby finger. The first and second depending arms may each include a pair of retention ledges. The first and second depending arms may be resiliently deflectable to engage the opposing lateral sides of the fuse module housing. The cross bar may include opposing first and second ends, and the first and second depending arms may be inset from the opposing first and second ends. The first and second depending arms may be configured to snap-fit with the rectangular fuse module. The disconnect housing may include switchable contacts and a rotary switch actuator.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A removal tool accessory for a finger-safe rectangular fuse module of a fusible disconnect device, wherein the finger-safe rectangular fuse module includes a housing having an upper surface, opposing long sides having a length dimension, opposing short sides having a width dimension substantially less than the length dimension of the long sides, and terminal blades extending in spaced-apart parallel planes to one another, wherein the housing projects from the fusible disconnect device and is open and accessible from an exterior of the fusible disconnect device when the terminal blades are engaged to the fusible disconnect device;

the removal tool accessory comprising:

an elongated cross bar having opposing ends and an axial length dimension therebetween that exceeds the length dimension of the long sides of the finger-safe rectangular fuse module, and the elongated cross bar having a lateral width dimension substantially less than the axial length dimension;

first and second fuse engagement arms depending downwardly from the elongated cross bar, the first and second fuse engagement arms respectively spaced inwardly from the opposing ends of the elongated cross bar, the first and second fuse engagement arms defining an interior cavity that receives the exposed housing of the finger-safe rectangular fuse module while the terminal blades are engaged to the fusible disconnect device, the interior cavity spanning the upper surface of the finger-safe rectangular fuse module and receiving respective portions of the opposing short sides of the finger-safe rectangular fuse module;

wherein an interior side of the first and second fuse engagement arms each respectively includes a generally wedge-shaped leading end and first and second retention ledges spaced from the wedge-shaped leading end, the first and second retention ledges engaging corresponding first and second projections on an exterior of each of the opposing short sides of the exposed housing of the finger-safe rectangular fuse module with snap-fit engagement when the portions of the lateral sides are fully received in the interior cavity; and a hand grip portion integrally formed with and extending upwardly from the elongated cross bar at each of the opposing ends of the elongated cross bar.

2. The removal tool accessory of claim 1, wherein the hand grip portion comprises a pair of upright arms extending upwardly from the elongated cross bar at each respective opposing end of the elongated cross bar, and an elongated handlebar extending between the pair of upright arms.

3. The removal tool accessory of claim 2, wherein the elongated handlebar defines a curved gripping surface for fingers of person, the curved gripping surface having convex curvature and concave curvature.

4. The removal tool accessory of claim 3, wherein the curved gripping surface is designed to allow the person to wrap four fingers of one hand around the curved gripping surface.

5. The removal tool accessory of claim 1, wherein the first and second fuse engagement arms are resiliently deflectable.

6. The removal tool accessory of claim 1, wherein the first and second fuse engagement arms are spaced apart from one another by more than 5.33 millimeters.

7. The removal tool accessory of claim 6, wherein the first and second fuse engagement arms are spaced apart from one another by more than 19.30 millimeters.

8. The removal tool accessory of claim 1, wherein the first and second fuse engagement arms are spaced apart from one another by at least 47.75 millimeters.

9. The removal tool accessory of claim 8, wherein the first and second fuse engagement arms are spaced apart from one another by at least 54.10 millimeters.

10. The removal tool accessory of claim 9, wherein the first and second fuse engagement arms are spaced apart from one another by at least 76.45 millimeters.

11. The removal tool accessory of claim 1, wherein the upright arms and the elongated handlebar have a lateral width dimension substantially less than the lateral width dimension of the elongated cross bar.

12. A removal tool accessory for an exposed rectangular fuse module projecting from a fusible disconnect device, the rectangular fuse module having long sides and short sides, the removal tool accessory comprising:

a fuse engaging portion comprising an elongated cross bar having opposing ends and a first axial dimension between the opposing ends, the elongated cross bar also having a lateral width dimension substantially less than the first axial dimension;

first and second depending arms extending from the elongated cross bar and respectively spaced apart by a distance less than the first axial dimension and about equal to the long sides of the rectangular fuse module, the first and second depending arms defining an interior cavity therebetween to receive and engage the short sides of the exposed rectangular fuse module;

wherein the first and second depending arms include interior-facing wedge-shaped leading ends including retention ledges to that engage corresponding first and second projections on an exterior of each of the short sides of the exposed rectangular fuse module with snap-fit engagement; and a hand grip portion integrally formed with the elongated cross bar, the hand grip having a width dimension less than the lateral width dimension of the elongated cross bar.

13. The removal tool accessory of claim 12, wherein the hand grip portion comprises a pair of upright arms extending from the elongated cross bar at the opposing ends, and an elongated handlebar extending between the pair of upright arms.

14. The removal tool accessory of claim 13, wherein the enlongated handlebar defines a curved gripping surface for a person's fingers, the curved gripping surface having a convex curvature and a concave curvature.

15. The removal tool accessory of claim 13, wherein the enlongated handlebar, the pair of upright arms, and the cross bar define an opening that accommodates a four finger engagement of a person in use.

16. The removal tool accessory of claim 12, wherein the first and second depending arms are resiliently deflectable.

17. The removal tool accessory of claim 12, wherein the first and second depending arms are spaced apart from one another by more than 5.33 millimeters.

18. The removal tool accessory of claim 17, wherein the first and second depending arms are spaced apart from one another by more than 19.30 millimeters.

19. The removal tool accessory of claim 12, wherein the first and second depending arms are spaced apart from one another by at least 47.75 millimeters.

20. The removal tool accessory of claim 19, wherein the first and second depending arms are spaced apart from one another by at least 54.10 millimeters.

21. The removal tool accessory of claim 20, wherein the first and second depending arms are spaced apart from one another by at least 76.45 millimeters.

* * * * *